US006371196B1

(12) United States Patent
Tsai et al.

(10) Patent No.: US 6,371,196 B1
(45) Date of Patent: Apr. 16, 2002

(54) INJECTION MOLDING APPARATUS

(75) Inventors: Lang-Fu Tsai, Hsinchu; Hsin-Hung Lin, Taichung; Yuh-Long Lin, Ilan; Hsuan Peng; Chi-Shien Lee, both of Taipei; Wen-Min Hsu, Miaoli; Ming-Lang Chang; Wann-Fu Su, both of Hsinchu, all of (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 0 days.

(21) Appl. No.: 09/552,881

(22) Filed: Apr. 20, 2000

(30) Foreign Application Priority Data

Feb. 18, 2000 (TW) ..... 89202590 U

(51) Int. Cl.[7] ..... B22D 17/00
(52) U.S. Cl. ..... 164/312
(58) Field of Search ..... 164/312, 314, 164/113, 900; 425/561, 585, 587

(56) References Cited

U.S. PATENT DOCUMENTS 4,417,616 A * 11/1983 Seitz ..... 164/113
4,439,123 A * 3/1984 Sano et al. ..... 425/112
4,836,267 A * 6/1989 Ueno et al. ..... 164/113
4,884,621 A * 12/1989 Ban et al. ..... 164/4.1
5,014,767 A * 5/1991 Ueno ..... 164/312
5,040,589 A * 8/1991 Bradley et al. ..... 164/113
5,284,201 A * 2/1994 Hegel et al. ..... 164/312
5,501,266 A * 3/1996 Wang et al. ..... 164/113
5,664,618 A * 9/1997 Kai et al. ..... 164/312
5,701,944 A * 12/1997 Young ..... 164/113
5,735,333 A * 4/1998 Nagawa ..... 164/113
5,836,372 A * 11/1998 Kono ..... 164/113

FOREIGN PATENT DOCUMENTS

JP 9-225979 * 9/1997 ..... B22D/17/26

* cited by examiner

*Primary Examiner*—M. Alexandra Elve
*Assistant Examiner*—Kevin P. Kerns
(74) *Attorney, Agent, or Firm*—Rabin & Berdo, P.C.

(57) ABSTRACT

An injection molding apparatus has a barrel for conveying a molten substance, a screw, a first base for supporting the barrel, a power unit, a second base for supporting the power unit, links, a motor, a screw driver, a plurality of injection guide links, and an injection connecting plate. The first base is threadedly secured to the bed. The barrel has one end secured to the first base. The power unit is fixed on the second base. The links each have one end connected to the first base and the other end connected to the second base. The screw driver between the bases is moved under the guidance of the injection guide links. The injection guide links penetrate through the second base, having one end secured to the screw driver with the injection connecting plate provided in the second base. The injection connecting plate is pivotably secured to the power unit. These features are adopted to the deformation caused by heat, and provide a closed loop of force, isolation of deformation, and a modular design that is particularly suitable to high speed injection molding.

12 Claims, 3 Drawing Sheets

INJECTION MOLDING APPARATUS

FIELD OF THE INVENTION

The present invention relates to injection molding devices and more particularly to an injection molding apparatus having features as adapted to the deformation caused by heat, closed loop of force, isolation of deformation, and modular design.

BACKGROUND OF THE INVENTION

A conventional injection molding process comprises the steps of feeding a heated liquid (e.g., magnesium, aluminum, zinc alloy, or thermoplastic substances having a temperature over 300° C.) from supply means to barrel, blending and conveying the material forward through the rotating screw, controlling the volume of material and injecting the same into a die cavity when pressure of material builds up to a predetermined value, and cooling and setting. In view of the foregoing, liquid is always kept at a high temperature environment between the supplying and injecting phases.

A conventional injection molding apparatus is illustrated in FIG. 1 wherein a high temperature is maintained from the section of supply means 12*b* and throat portion 12*c* to barrel 12*a* for uniformly feeding material. It is found that heat is transferred to base 10*a* and links 11*a* by conduction. As such, the apparatus may be deformed by heat, which in turn causes a parallel deviation between links 11*a,* thus deteriorating the injection performance.

For example, in an injection molding apparatus for magnesium alloy, molten magnesium alloy has a flow temperature about 580° C. Also, barrel 12*a* is kept at above 650° C. due to the above heat convection effect. As such, base 10*a* and each link 11*a* have 225° C. and 168° C. temperature rises, respectively, due to heat transferred from barrel 12*a* to base 10*a* and links 11*a.* As such, a parallel deviation between links 11*a* connected to base 10*a* is generated. In an experiment data, deviation in one link 11*a* is more than 0.16 mm in the horizontal direction and more than 0.06 mm in the vertical direction, respectively. As a result, performance of the apparatus and precision of products both deteriorate significantly.

SUMMARY OF THE INVENTION

It is thus an object of the present invention to provide an injection molding apparatus comprising a barrel for conveying molten substances, a screw, a first base for supporting the barrel, a power unit, a second base for supporting the power unit, a plurality of links, a screw driving means, a plurality of injection guide links, and an injection connecting plate wherein the first base is threadedly secured to the bed. Further, a potential lengthening of links caused by injection is avoided by the slidingly movable second base on the rail of the bed. As such, deformation of bases caused by connected links during operation is prevented. Also, the fastening zone of the first base is coincident in the centerline of the barrel. As such, any deformation in the barrel caused by heat is uniformly distributed to either side of the centerline. Thus, an uneven deformation of bases is avoided, thereby maintaining the centerlines of screw and barrel substantially coincident. This apparatus can manufacture high precision products.

It is another object of the present invention to provide an injection molding apparatus wherein the force generated by the power unit during injection is transmitted through the injection connecting plate, injection guide links, screw driving means, screw, barrel, first base, links, second base, and back to the power unit to form a closed loop without passing through the bed. As such the bed only provides a support for the apparatus without additional force and torque being exerted thereon. This greatly decreases the reliance of components of the apparatus on bed during injection.

It is still another object of the present invention to provide an injection molding apparatus wherein the links simply act as transmitting injection force such that any potential deformation thereof caused by heat is minimized. This apparatus is particularly suitable to high speed injection molding with the linear moving speed of the rotating screw over two meters per second (2 m/s).

It is still another object of the present invention to provide an injection molding apparatus wherein the first base is the most important component such that the designs and geometry of all other components are conformed to the first base rather than the bed. As a result, no positioning device and associated geometry precision is required in the bed. This greatly simplifies assembly of the apparatus.

The above and other objects, features, and advantages of the present invention will become apparent from the following detailed description taken with the accompanying drawings.

DETAILED DESCRIPTION OF THE PREFERRED EMBODIMENTS

Figure 1:
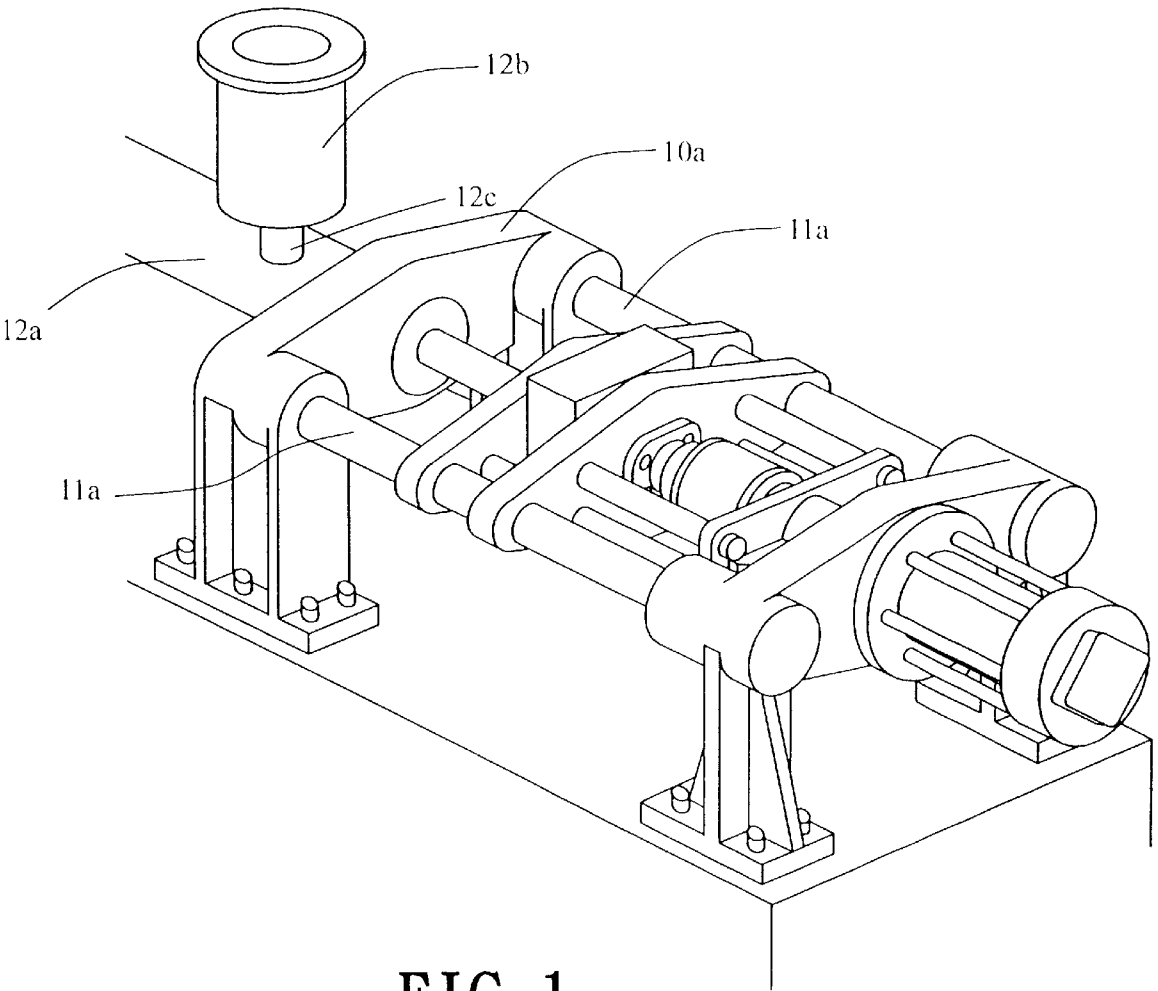
FIG. 1 PRIOR ART
FIG. 1 is a perspective view of a conventional injection molding apparatus.
Figure 2:
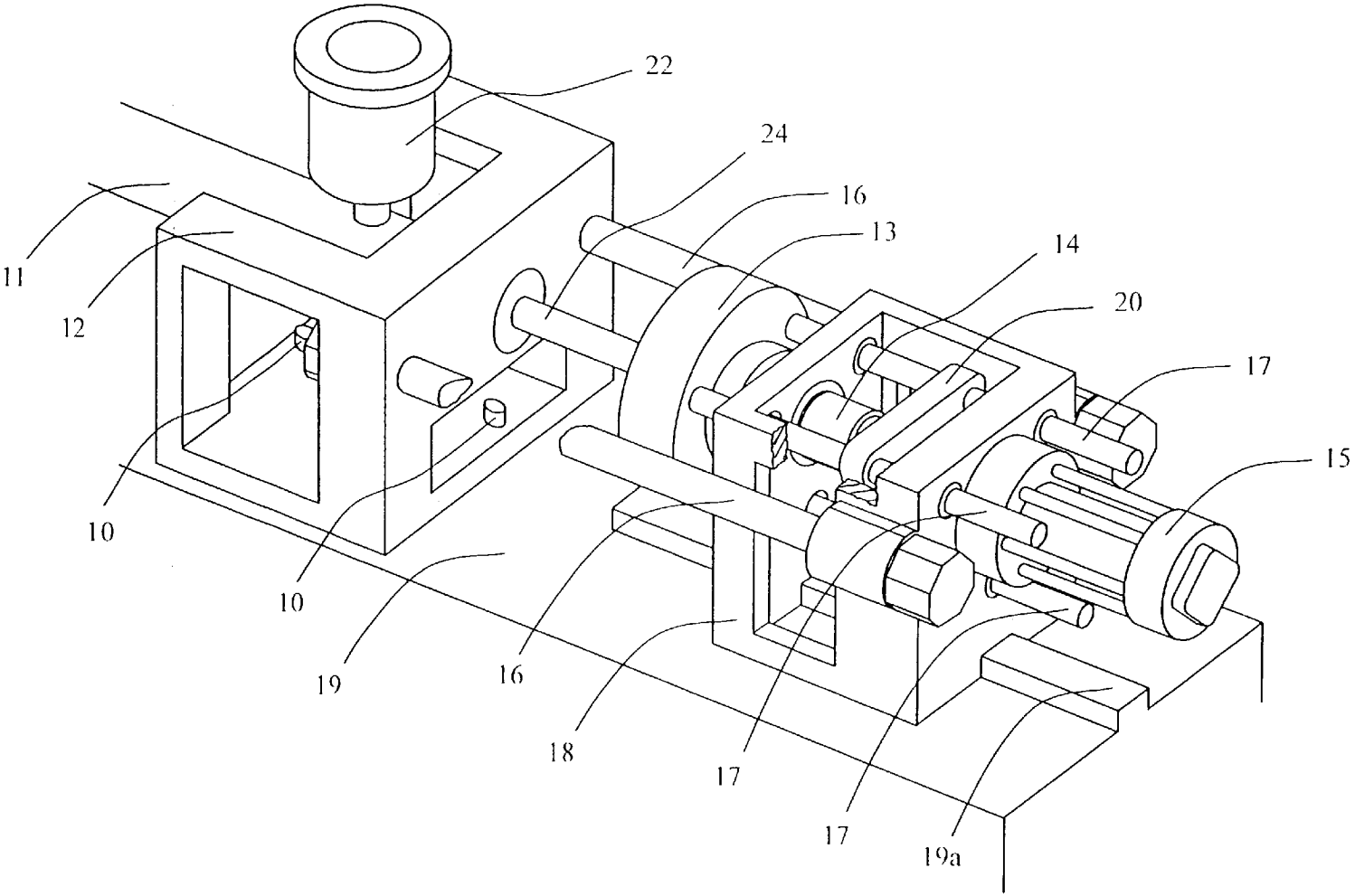
FIG. 2 is a perspective view of an injection molding apparatus according to the invention.
Figure 3:
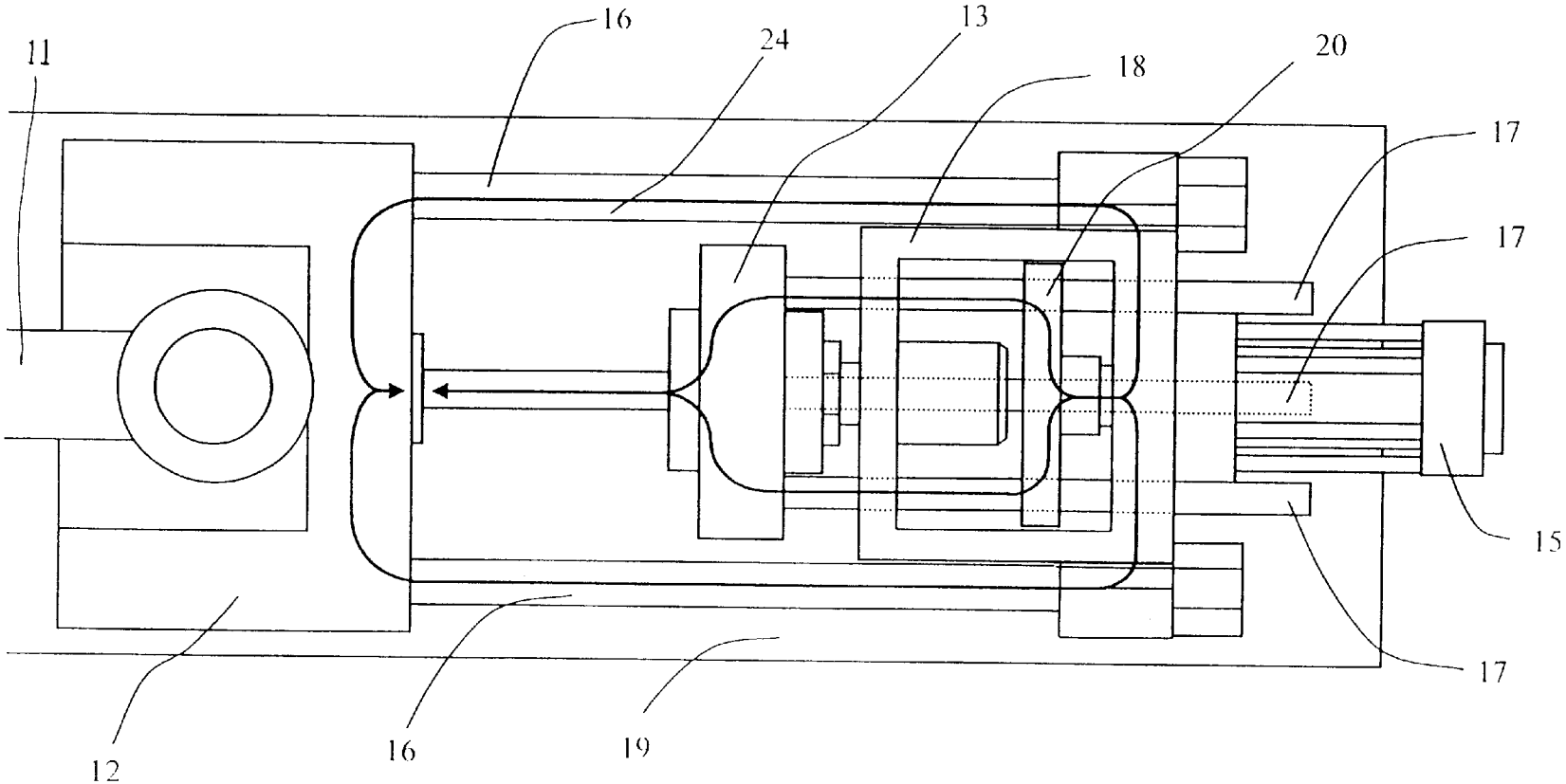
FIG. 3 is a top view illustrating the force loop during injection molding.

Referring to FIGS. 2 and 3, there is shown an injection molding apparatus constructed in accordance with the invention comprising a barrel 11 for conveying molten substances, a screw 24 for blending and pushing the conveyed substance down the barrel 11, a first base 12 for supporting barrel 11, a power unit 15, a second base 18 for supporting power unit 15, a plurality of links 16, a motor 14, a screw driving means 13, a plurality of injection guide links 17, and an injection connecting plate 20 wherein the first base 12 is threadedly secured to bed 19 by means of bolt and nut combinations 10. Screw 24 is axially provided along the center of the bore of barrel 11. Barrel 11 has one end secured to first base 12. Motor 14 can drive screw 24 to rotate in the barrel 11. It is appreciated by those skilled in the art that screw and motor can be replaced by hydraulic plunger and pump to effect a reciprocating motion. A supply means 22 is provided on top of barrel 11 for feeding a high temperature liquid therein. Second base 18 is appropriately spaced apart from first base 12. Power unit 15 is fixed on second base 18. Power unit 15 is powered by a high pressure fluid tank or motor driven guide screw. A rail 19*a* is provided on bed 19. Second base 18 is slidingly movable along rail 19*a*. One ends of links 16 are connected to first base 12, while the other ends are connected to second base 18. Output shaft of motor 14 is through the central hole of screw driving means 13 to connect with one end of screw 24. Alternatively, output shaft of motor 14 and the above end of screw 24 may be coupled together in screw driving means 13 for transmitting the rotation motion to screw 24. A cooling loop is formed in cooling device (not shown) of screw driving means 13 for lowering the temperature of screw driving means 13 being heated by high temperature supply means 22, barrel 11, and first base 12. Injection guide links 17 are penetrated through second base 18 having one end secured to screw driving means 13. An injection connecting plate 20 is provided in second base 18 connecting injection guide links 17. Injection connecting plate 20 is further fixedly connected to the output end of power unit 15. In operation, injection connecting plate 20 is driven by power unit 15 which in turn drives screw driving means 13 because injection connecting plate 20 and screw driving means 13 are fixedly secured to injection guide links 17. Then screw 24 is driven to rotate to extrude material from barrel 11 for injecting the same into die cavity.

The injection molding process of the invention comprises the steps of feeding high temperature liquid from supply means 22 to barrel 11, blending and conveying the material forward through the rotating screw 24, controlling the volume of material and injecting the same into die cavity when pressure of material builds up to a predetermined value, and cooling and setting.

The features of the invention are summarized as below.

1. Adapted to the deformation caused by heat. A lengthening of links caused by injection is inevitable. As such, only a suitable limitation on the potential lengthening is possible. In this invention, the first base 12 is threadedly secured to bed 19. Further, a potential lengthening, of links 16 caused by injection is avoided by the slidingly movable second base 18 on rail 19*a* of bed 19. As such, deformation of bases 12 and 18 caused by connected links 16 during operation is prevented. Also, the fastening zone of first base 12 is coincident in the center line of barrel 11. As such, any deformation in barrel 11 caused by heat is uniformly distributed to either side of the center line of barrel 11. Thus, an uneven deformation of bases 12 and 18 is avoided, thereby maintaining the center lines of screw 24 and barrel 11 substantially coincident. This apparatus can manufacture high precision products.

2. Closed loop of force. As shown in FIG. 3 specifically, force generated by power unit 15 during injection is transmitted through injection connecting plate 20, injection guide links 17, screw driving means 13, screw 24, and barrel 11 to first base 12. At this time, a force in reaction is generated in first base 12. Such force in reaction is further transmitted through links 16 and second base 18 and back to power unit 15 to form a closed loop without passing through bed 19. As such, bed 19 only provides a support for the apparatus without additional force and torque being exerted, thereon. This greatly decreases the reliance of components of the apparatus on bed 19 during injection.

3. Isolation of deformation. Links 16 simply act as transmitting injection force such that any potential deformation thereof caused by heat is minimum. This apparatus is particularly suitable to high speed injection molding with the linear moving speed of rotating screw over two meters per second (2 m/s).

4. Modular design. First base 12 is the most important component such that the designs and geometry of all other components are conformed to first base 12 rather than bed 19. As a result, no positioning device and associated geometry precision is required in bed 19. This greatly simplifies assembly of the apparatus.

While the invention herein disclosed has been described by means of specific embodiments, numerous modifications and variations could be made thereto by those skilled in the art without departing from the scope and spirit of the invention set forth in the claims.

What is claimed is:

1. An injection molding apparatus mounted on a bed comprising: a barrel for conveying molten substances;

a first base for supporting the barrel, the first base being threadedly secured to the bed;

a power unit having an output end;

a second base for supporting the power unit, the second base being spaced apart from the first base;

a rail on the bed for moveably supporting the second base, wherein the second base is slidingly movable along the rail;

a plurality of first links, each of the first links having a respective first end connected to the first base and a respective second end connected to the second base;

a motor having an output shaft;

a screw movable along the barrel having one end connected to the output shaft of the motor;

a screw driving means provided between the first base and the second base, for transmitting rotation motion from the motor output shaft to the screw;

a plurality of injection guide links, each of the guide links penetrating through the second base and having one end secured to the screw driving means; and an injection connecting plate provided in the second base and fixedly connected to the power unit, the injection connecting plate being penetrated by the plurality of injection guide links and moveably guided thereby at a predetermined position relative to the guide links.

2. The injection molding apparatus of claim 1, further comprising a supply means on the top of the barrel for feeding the molten substances into the barrel.

3. The injection molding apparatus of claim 1, wherein the screw and the motor respectively comprise a hydraulic plunger and a hydraulic pump.

4. The injection molding apparatus of claim 1, wherein the power unit is powered by one oft a high pressure fluid tank and a motor driven guide screw.

5. The injection molding apparatus of claim 1, wherein at least one of the screw, the barrel, and the first base are subject to heating during injection molding; and wherein the screw driving means is cooled by a cooling device for lowering the temperature of the screw driving means, heated by at least one of the screw, the barrel, and the first base.

6. The injection molding apparatus of claim 1, wherein the predetermined position of the injection connecting plate penetrated by the injection guide links is centered relative to the injection guide links.

7. The injection molding apparatus of claim 1, wherein the output end of the power unit is secured to one end of the injection connecting plate.

8. The injection molding apparatus of claim 1, wherein there are three injection guide links.

9. The injection molding apparatus of claim 8, wherein the predetermined position of the injection connecting plate penetrated by the injection guide links is centered relative to the injection guide links.

10. The injection molding apparatus of claim 1, wherein the output shaft of the motor and one end of the screw are coupled together in the screw driving means for transmitting a rotation motion to the screw.

11. An injection molding apparatus mounted on a bed comprising:

a barrel for conveying molten substances;

a first base for supporting the barrel, the first base being threadedly secured to the bed;

a power unit having an output end;

a second base for supporting the power unit, the second base being spaced apart from the first base;

a rail on the bed for moveably supporting the second base, wherein the second base is slidingly movable along the rail;

a motor having an output shaft;

a screw movable along the barrel having one end connected to the output shaft of the motor;

a screw driving means provided between the first base and the second base, for transmitting rotation motion from the motor output shaft to the screw;

a plurality of injection guide links, each of the guide links penetrating through the second base and having one end secured to the screw driving means; and an injection connecting plate provided in the second base and fixedly connected to the power unit, the injection connecting plate being penetrated by the plurality of injection guide links and moveably guided thereby at a predetermined position relative to the guide links.

12. The injection molding apparatus of claim 11, wherein the barrel is disposed in a center portion of the first base, thereby uniformly distributing a deformation of the first base caused by heat to either side of a center line of the first base.

* * * * *